US008444080B2

(12) United States Patent
Hagleitner

(10) Patent No.: US 8,444,080 B2
(45) Date of Patent: May 21, 2013

(54) PAPER DISPENSER

(76) Inventor: Hans Georg Hagleitner, Zell Am See (AT)

( * ) Notice: Subject to any disclaimer, the term of this patent is extended or adjusted under 35 U.S.C. 154(b) by 171 days.

(21) Appl. No.: 12/940,244

(22) Filed: Nov. 5, 2010

(65) Prior Publication Data

US 2011/0101147 A1 May 5, 2011

Related U.S. Application Data

(63) Continuation of application No. PCT/AT2009/000138, filed on Apr. 8, 2009.

(30) Foreign Application Priority Data

May 5, 2008 (AT) ..... A 704/2008

(51) Int. Cl.
*B65H 20/02* (2006.01)

(52) U.S. Cl.
USPC ..... 242/564.4; 242/423; 242/560

(58) Field of Classification Search
USPC ..... 242/560, 560.1, 564, 564.4, 423
See application file for complete search history.

(56) References Cited

U.S. PATENT DOCUMENTS

| | | | | |
|---|---|---|---|---|
| 5,868,343 | A | 2/1999 | Granger | |
| 6,363,824 | B1 | 4/2002 | Granger | |
| 6,550,714 | B1 | 4/2003 | Granger | |
| 6,591,727 | B1 * | 7/2003 | Purcell et al. | 225/42 |
| 6,736,348 | B1 | 5/2004 | Formon et al. | |
| 7,712,699 | B2 * | 5/2010 | Granger | 242/564.1 |
| 8,056,459 | B2 * | 11/2011 | Granger | 242/564.4 |

FOREIGN PATENT DOCUMENTS

| | | | |
|---|---|---|---|
| FR | 2 771 620 | A1 | 6/1999 |
| FR | 2 778 902 | A1 | 11/1999 |
| FR | 2 890 302 | A1 | 3/2007 |
| WO | 96/24281 | A1 | 8/1996 |
| WO | 02/00083 | A1 | 1/2002 |
| WO | 2007026103 | A1 | 3/2007 |

OTHER PUBLICATIONS

International Search Report of PCT/AT2009/000138, Dated August 14, 2009.

* cited by examiner

*Primary Examiner* — William A Rivera
(74) *Attorney, Agent, or Firm* — Laurence A. Greenberg; Werner H. Stemer; Ralph E. Locher

(57) ABSTRACT

A paper dispenser has a brake for a paper roll and a tensioning device for the web of paper and interacts in such a manner that the braking effect of the brake is adapted to the tension in the web of paper. The tensioning device is loaded in a paper path between the two conveying rollers and the paper reel.

6 Claims, 3 Drawing Sheets

PAPER DISPENSER

CROSS-REFERENCE TO RELATED APPLICATION

This is a continuation application, under 35 U.S.C. § 120, of copending international application No. PCT/AT2009/000138, filed Apr. 8, 2009, which designated the United States; this application also claims the priority, under 35 U.S.C. §119, of Austrian patent application No. A 704/2008, filed May 5, 2008; the prior applications are herewith incorporated by reference in their entirety.

BACKGROUND OF THE INVENTION

Field of the Invention

The invention relates to a paper dispenser, in particular for hygiene papers or the like.

Since dispensers of this type and the reels to be inserted therein of toilet papers, paper towels, etc. are not precision products, widely varying rolling properties are unavoidable. It is particularly unfavorable here if the reels are too easy-running, since too much paper can be pulled off in the case of manual removal and, in the case of existing discharging mechanisms, continued rotation of the reel can lead to loop formation in the interior which can of course bring about functional disruptions. There are therefore also various simple brakes, for example hoops which press against the circumference, brackets which press against the end sides, etc., which, however, have disadvantages above all if the braking operation becomes too intensive.

SUMMARY OF THE INVENTION

It is accordingly an object of the invention to provide a paper dispenser which overcomes the above-mentioned disadvantages of the prior art devices of this general type.

With the foregoing and other objects in view there is provided, in accordance with the invention a paper dispenser. The paper dispenser contains a brake for a paper reel, two conveying rollers defining a nip therebetween, a paper path of a paper web leading through the nip between the two conveying rolls, and a tensioning device for the paper web. The tensioning device interacts with the brake, and the tensioning device is loaded in the paper path between the two conveying rollers and the paper reel.

The invention then proposes in a paper dispenser to allow a brake for a paper reel and a tensioning device for the paper web which comes from the reel to interact in such a way that the braking action of the brake is adapted to the tension in the paper web.

This means that, in the case of a low tension in the paper web which could have the consequence of sagging or the risk of a loop, the braking force on the paper reel is increased, it being possible for the paper reel to be rotated only with an increased force application during the next paper removal, as a result of which the paper sagging is eliminated at the beginning. The paper web is therefore increasingly tensioned, that is to say the tension in the paper web is increased, which, according to the invention, leads to the reduction in the braking action, with the result that the paper reel becomes more easy-running again.

The result of this is that an equilibrium will be set, that is to say the tension and the braking action are substantially in balance. The tensioning device can be loaded by gravity or preferably by a spring, with the result that every installation arrangement becomes possible.

The equalization according to the invention between tension and braking action is particularly advantageous in the case of paper dispensers which, in addition to the dispensing reel, have a reserve reel and a device for transferring the paper web of the reserve reel into a conveying roll nip as soon as the dispensing reel is exhausted. Precisely during the transfer of the reserve reel, there should be a sufficient rotational resistance at the reserve reel until the ratio of tensioning force and braking force has evened out.

There is provision in one preferred embodiment for the tensioning device to have a pivotable, U-shaped hoop and for the brake to have a brake lever which presses on the front side onto the reel and can be actuated by a side part of the hoop. The brake lever is provided, for example, on a rocker which is provided with a rising rib, onto which the side part of the hoop runs. If the side part moves in the opposite direction, the brake is loosened.

There is provision in a further preferred embodiment for a lever to project from the side part of the hoop, which lever is coupled kinematically to the cover of the dispenser by a bracket in such a way that, when the cover is open, the tensioning device is pivoted out of the paper path and the brake is released. The pivoting out of the tensioning device facilitates the insertion of the paper reel and the assignment of the start of the paper web to the device for transferring the paper web as soon as the dispensing reel is exhausted. If the cover is subsequently closed again, the hoop pivots until the paper web is tensioned. If the pivoting goes beyond an equalized center position, the brake is also engaged.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
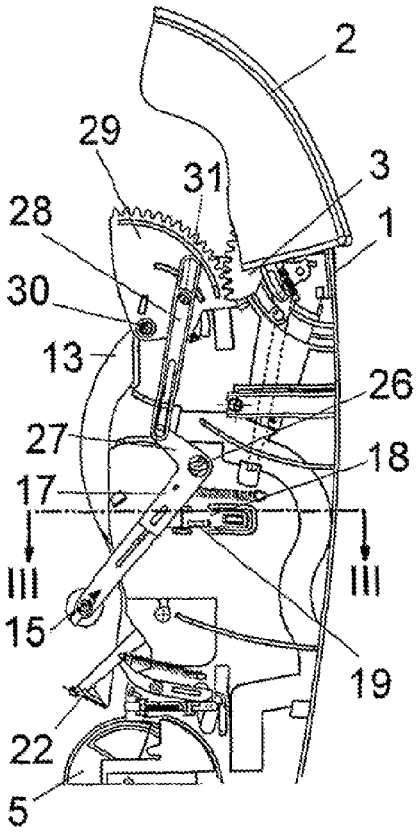
FIG. 1 is a diagrammatic, side view of one preferred embodiment of a paper dispenser with an open cover, without a side wall, according to the invention.
Figure 6:
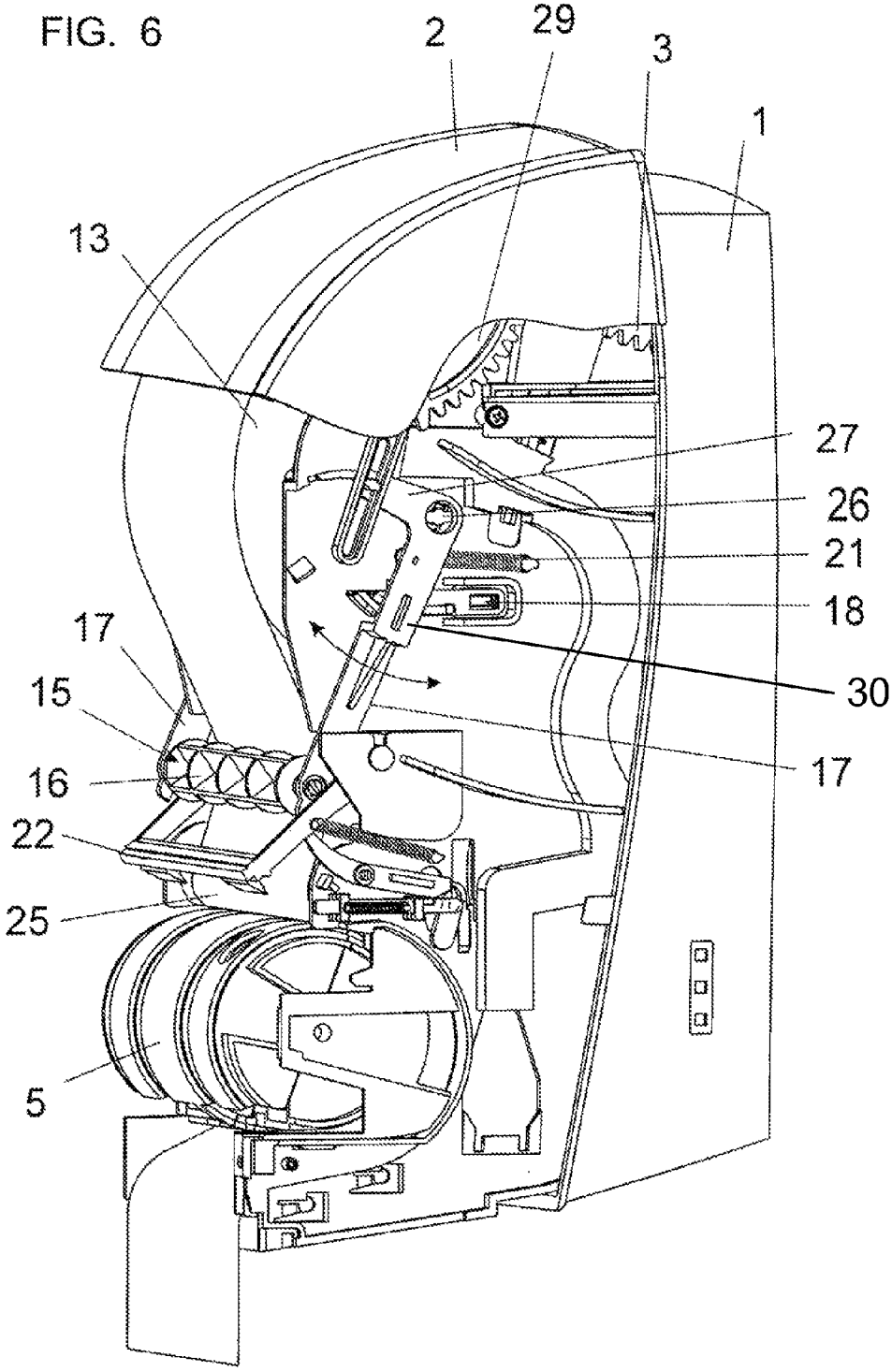
FIG. 6 is a diagrammatic, perspective view of the paper dispenser according to FIG. 2.

Referring now to the figures of the drawing in detail and first, particularly, to FIGS. 1 and 6 thereof, there is shown a dispenser for paper from at least one reel 13. The dispenser has a housing 1 with a cover 2 which can be pivoted upward and moves a bracket 28 via a gear mechanism which has tooth segments 3, 29, in which bracket 28 a slot is provided. The slot is penetrated by a pin which is arranged on a lever 27 which can be rotated about an axis 26. Here, the lever 27 projects from a side part 17 of a U-shaped hoop 30 which forms a part of a tensioning device 15 for a paper web 25 and can likewise be pivoted about the axis 26. A tensioning roller 16 is arranged rotatably on the transverse part of the hoop 30, which tensioning roller 16 pivots into the path of the paper web 25 in a manner which is loaded by gravity or preferably by a spring 21.

Figure 5:
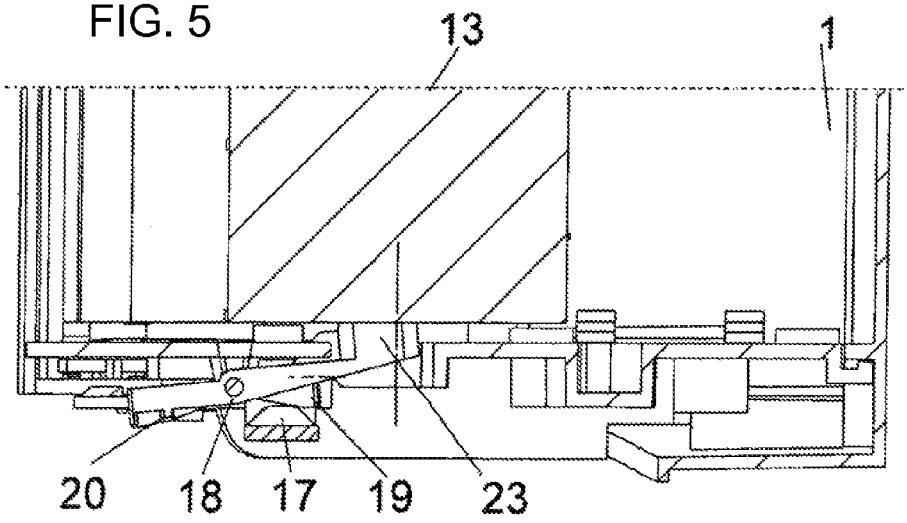
FIG. 5 is a diagrammatic, sectional view according to FIG. 3 through the position shown in FIG. 4.

The side part 17 engages over a rocker 18 (FIG. 3, FIG. 5) which can be pivoted about an axis and has in each case one rising rib 19 and 20 on both lever arms. When the side part 17 moves to and fro about the axis 26, it actuates the rocker 18, as can be seen from the comparison of the two FIGS. 3 and 5. That arm of the rocker 18 which carries the rib 19 represents a brake lever which can press with a brake shoe 23 against the front side of the reserve reel 13.

Figure 3:
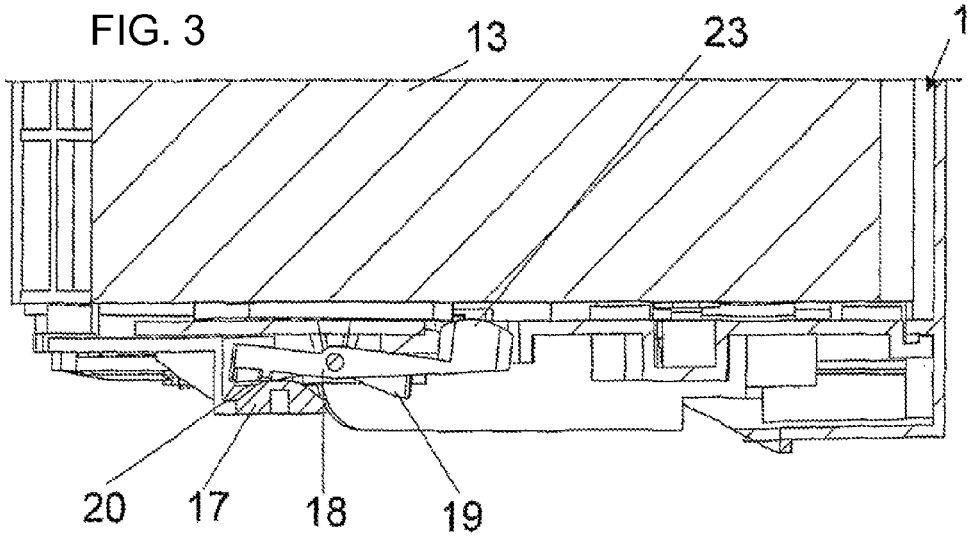
FIG. 3 is a diagrammatic, sectional view taken along the line III-III shown in FIG. 1.

When the cover 2 is open, as can be seen from FIG. 1, the bracket 28 is pulled upward and the tensioning device 15 is deflected to the left about the axis 26, since the side part 17 and the lever 27 project from one another approximately at right angles. The side part 17 has run onto the rib 20 of the rocker 18 and holds the latter in the position which is shown in FIG. 3 and in which the brake shoe 23 is raised up from the braking position.

Figure 2:
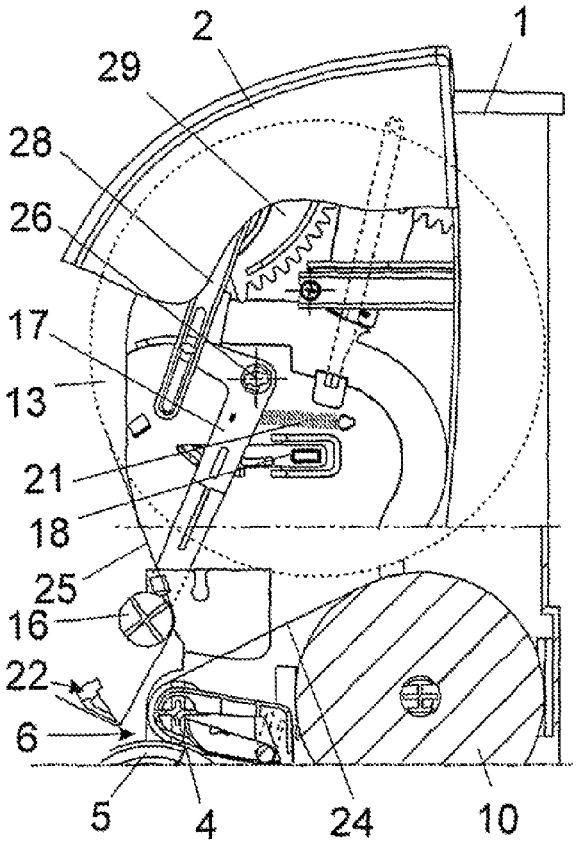
FIG. 2 is a diagrammatic, side view of a detail from FIG. 1 with a closed cover.
Figure 4:
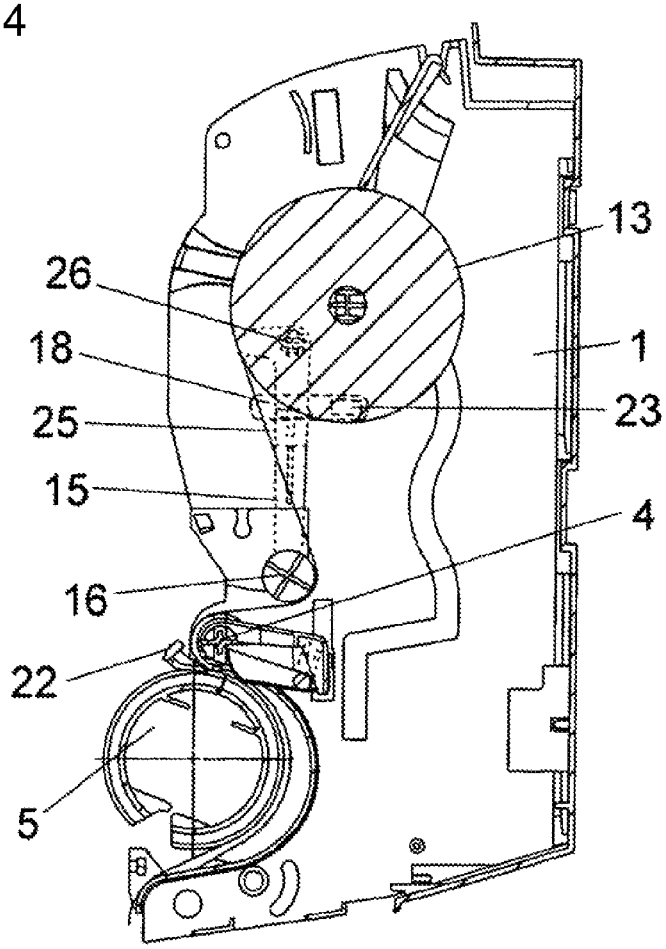
FIG. 4 is a diagrammatic, center longitudinal sectional view through the paper dispenser according to FIG. 1.

A reserve reel 13 is inserted, and the start of the paper web 25 is guided through behind the pivoted outward tensioning roller 16 and is fixed on a device 22, the purpose of which is to thread the paper start of the reserve reel 13 into a nip 6 between two conveying rolls 4 and 5 when the dispensing reel 10 shown in FIG. 2 is exhausted. The position of that component of the device 22 which is important for this purpose is indicated in FIG. 4.

If the cover 2 is then closed, the bracket 28 is moved downward and releases the U-shaped hoop 30 of the tensioning device 15 (see FIG. 2 and FIG. 6), the tensioning roller 16 of which presses onto the paper web 25 which is held in the conveying roll pair 4, 5. The paper web 25 is tensioned, it being possible for the position of the tensioning device 15 to vary between the position shown in FIG. 2 and the position shown in FIG. 4. In the approximately central position according to FIG. 2, the brake shoe 23 of the rocker 18 bears only lightly against the front side of the reserve reel 13, with the result that the latter is braked from not at all to only a little. If the reserve reel 13 rotates too easily, paper is pulled off from the tensioning device 15, and the tensioning device 15 pivots further to the right under the action of the spring 21, which increases the pressure of the brake shoe 23 on the reserve reel 13, since the side part 17 runs onto the rising rib 19. The tension in the paper web 25 increases and an equilibrium is set between tension and braking force.

If paper is conveyed by the conveying roll 4, 5, the tensioning device 15 will pivot back to the left and the brake will loosen a little if the braking action is too high, and will move further to the right and increase the brake pressure if the braking action is too low. In any case, uncontrollable unraveling of the paper web 25 from a reserve reel 13 which runs too easily is avoided.

The paper dispenser according to the invention can have a dispensing reel 10 and a reserve reel 13, the paper of which is taken over by the device 22 after exhaustion of the paper of the dispensing reel 10 and is fed to the conveying rolls 4, 5, with the result that paper can continue to be removed and the refilling can take place not at this instant, but rather at some later time before exhaustion of the reserve reel.

The equalization of the braking action to a changing paper tension is by nature independent of the presence of the dispensing reel, with the result that the dispenser can also be of smaller and simpler construction, by it being possible for all the components which are required only for the dispensing reel and the paper change to be omitted. The reserve reel is then the dispensing reel, and it goes without saying that the uncontrolled unraveling in the housing is also to be avoided in this case.

The invention claimed is:

1. A paper dispenser, comprising:

a brake for a paper reel;

two conveying rollers defining a nip therebetween, a paper path of a paper web leading through said nip between said two conveying rolls; and a tensioning device for the paper web, said tensioning device interacting with said brake, said tensioning device being disposed and loaded in the paper path between said two conveying rollers and the paper reel.

2. The paper dispenser according to claim 1, further comprising a housing having receiving spaces for a dispensing reel and the paper reel being a reserve reel, paper webs of the dispensing reel and the reserve reel can be guided one after another through said nip between said two conveying rollers;

further comprising a device for transferring the paper; and wherein said tensioning device is disposed between the reserve reel and said device which transfers the paper web of the reserve reel into said nip after exhaustion of paper of the dispensing reel.

3. The paper dispenser according to claim 1, wherein:

said tensioning device has a U-shaped hoop which can be pivoted in a spring loaded manner and over which the paper web is guided, said U-shaped hoop has a side part; and said brake has a brake lever which presses on a front side onto the paper reel and can be actuated by said side part of said U-shaped hoop.

4. The paper dispenser according to claim 3, wherein said brake lever forms one arm of a rocker with a rising rib, onto which said side part of said U-shaped hoop runs.

5. The paper dispenser according to claim 4, further comprising a cover;

further comprising a bracket; and wherein said tensioning device has a lever projecting from said side part of said U-shaped hoop, said lever is coupled kinematically to said cover by means of said bracket in such a way that, when said cover is open, said tensioning device is pivoted out of the paper path and said brake is released.

6. The paper dispenser according to claim 5, wherein said rocker has a further arm with a rising rib, and when said cover is open, said side part of said U-shaped hoop runs onto said rising rib on said further arm of said rocker.

* * * * *